United States Patent [19]

DeRenzo

[11] Patent Number: 4,640,025

[45] Date of Patent: Feb. 3, 1987

[54] FIGURE EIGHT SHOE TIE SYSTEM

[76] Inventor: Joseph M. DeRenzo, P.O. Box 6833, Thousand Oaks, Calif. 91359

[21] Appl. No.: 724,235

[22] Filed: Apr. 17, 1985

[51] Int. Cl.[4] ..... A43B 5/00; A43B 11/00; A61F 13/06

[52] U.S. Cl. ..... 36/50; 36/114; 128/166

[58] Field of Search ..... 36/50, 89, 114; 128/80 H, 166, 166.5

[56] References Cited

U.S. PATENT DOCUMENTS

| | | | |
|---|---|---|---|
| 1,773,127 | 8/1930 | Auster | 128/166.5 |
| 3,327,410 | 6/1967 | Park, Sr. et al. | 36/50 |
| 3,534,957 | 10/1970 | Norman et al. | 128/166 |
| 3,566,486 | 3/1971 | Conway | 36/114 |
| 4,236,328 | 12/1980 | Friedlander | 128/166 |
| 4,282,659 | 8/1981 | Bourque et al. . | |
| 4,296,558 | 10/1981 | Antonious . | |
| 4,308,672 | 1/1982 | Antonious . | |
| 4,366,631 | 1/1983 | Larsen et al. . | |
| 4,411,077 | 10/1983 | Slavitt | 36/114 |
| 4,461,288 | 7/1984 | Curtis | 128/166 |
| 4,476,639 | 10/1984 | Zaccaria | 36/50 |

FOREIGN PATENT DOCUMENTS

| | | | |
|---|---|---|---|
| 1158039 | 12/1983 | Canada | 36/114 |
| 16901 | of 1900 | United Kingdom | 36/50 |

*Primary Examiner*—Werner H. Schroeder

*Attorney, Agent, or Firm*—Henderson & Sturm

[57] ABSTRACT

The present invention relates to an improved tie system (10) for shoes (13), and comprises an elongated strap element (17) that passes under the arch (21) of a user's foot (20), over the top of the shoes (13) and encircles the user's ankle (22) to produce a generally figure eight wrapping configuration.

1 Claim, 9 Drawing Figures

FIG. 1.
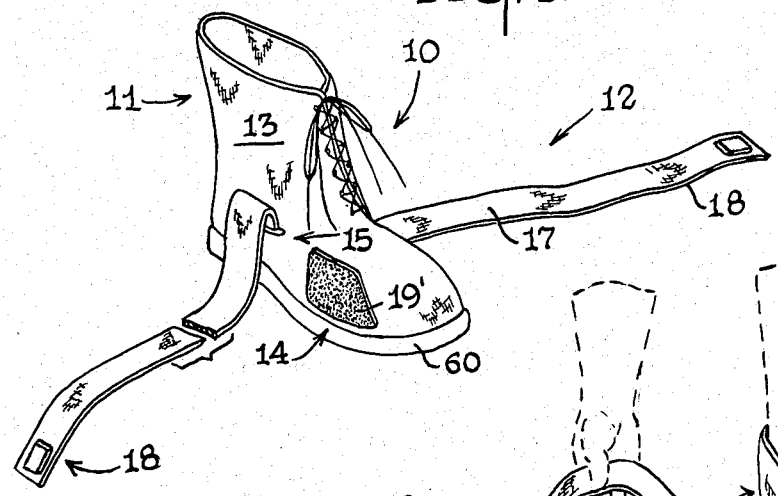
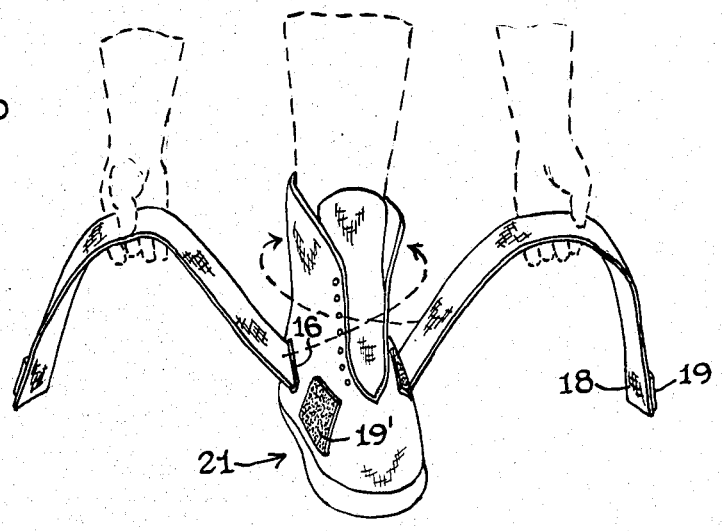
FIG. 2.
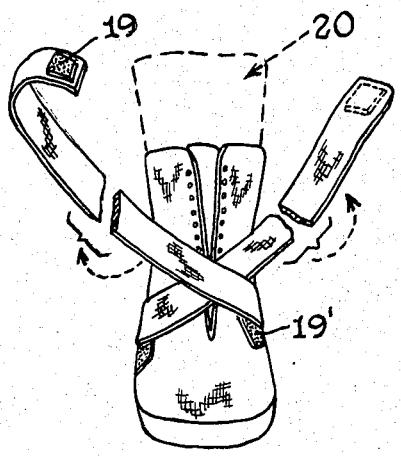
FIG. 3.
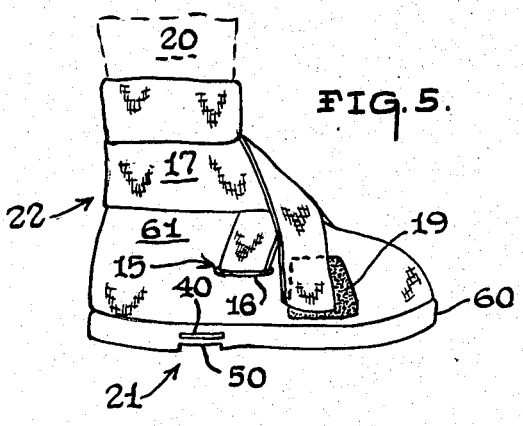
FIG. 5.
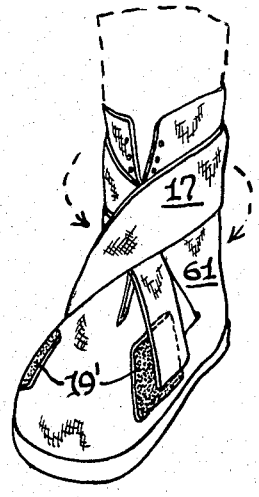
FIG. 4.

FIGURE EIGHT SHOE TIE SYSTEM

TECHNICAL FIELD

The present invention relates generally to securing arrangements for footwear.

BACKGROUND OF THE INVENTION

The prior art is replete with closure and securing arrangements for boots, shoes, sandals or the like as evidenced by U.S. Pat. Nos. 4,308,672; 4,366,631; 4,296,558; and 4,282,659. As can be seen by reference to these prior art patents, the various and diverse arrangements have been developed to accomplish myriad functions. It is also noted that support, comfort, and ease of operation seem to be the common themes that tie these constructions together.

While all of the aforementioned prior art devices are more than adequate for their intended purposes, they leave alot to be desired with respect to the combination of both a tie system and a support system into an integrated footwear construction.

Athletic and outdoor footwear in particular are normally constructed in such a manner that the body of the shoe, boot, etc. provides the support structure, when the cooperating portions of the footwear are engaged in their operative dispostion by securing means such as laces, straps, buckles, etc.

In virtually every known instance, the securing means enumerated above, merely function as intended; and offer very little, if any, additional support for the user's foot and ankles. With this deficiency in the prior art construction having been recognized, a new system for tying and securing footwear was sought; and, as a result of trial and error, the system that forms the basis of the present invention was developed.

BRIEF DESCRIPTION OF THE INVENTION

The shoe tie system that forms the basis of the present invention was developed specifically to provide an added element of support to any type of footwear into which it is incorporated.

The shoe tie system in question comprises a standard footwear construction such as a boot, shoe, sneaker, sandal or the like, and an elongated strap element operatively associated with the footwear; wherein, the strap element encircles the user's foot and wraps around the user's ankle.

The encirclement of the user's ankle and foot produces a quasi figure eight wrapping configuration, which not only provides improved arch support, but also provides increased lateral and vertical stability for the user's ankles.

BRIEF DESCRIPTION OF THE DRAWINGS

These and other objects, advantages, and novel features of the invention will become apparent from the detailed description of the best mode for carrying out the invention, when considered in conjunction with the accompanying drawings, wherein:

FIG. 1 is a perspective view of the preferred embodiment of the shoe tie system prior to operative disposition;

FIGS. 2 through 4 depict the progressive encirclement of the user's foot;

FIG. 5 is a side view of the tie system in its operative disposition;

BEST MODE FOR CARRYING OUT THE INVENTION

Figure 6:
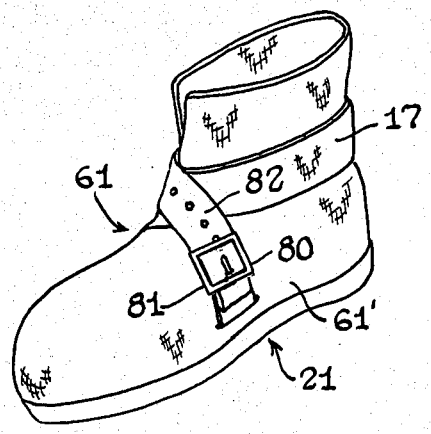
FIG. 6 depicts an alternate embodiment of the shoe tie system.
Figure 7:
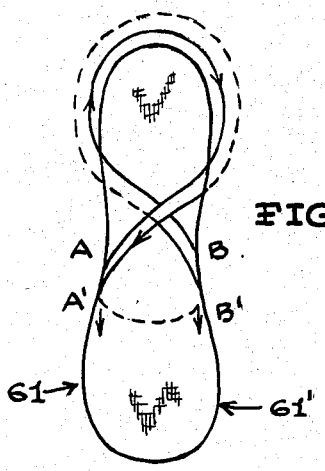
FIG. 7 depicts the preferred mode of foot encirclement provided by the preferred embodiment.

As can be seen by reference to FIG. 1, the shoe tie system that comprises the present invention is designated generally by the numeral (10). The tie system (10) comprises in general a footwear unit (11) and an elongated strap unit (12). These units will now be described in seriatim fashion.

The footwear unit (11) may comprise a boot, shoe, sandal, sneaker, or the like. For purposes of illustration only, the footwear unit (11) has been depicted as a boot designated by the numeral (13); however, it is to be understood that the tie system (10) may be incorporated into any type of footwear construction. Furthermore, in describing this invention, the term "shoe" will be used as a generic term for footwear.

As can best be seen in FIGS. 1, 4 and 5, portions (14) of the shoe (13) are provided with receiving means (15) that will cooperate with the elongated strap unit (12) to allow the strap unit (12) to encircle the user's foot and ankle in a generally figure eight configuration.

In the embodiment depicted, the receiving means (15) comprises aligned elongated apertures or slits (16) disposed on opposite sides of the shoe (13) and above the normal location of the arch (21) of the user's foot (20) when wearing the shoe. The means (15) may also comprise other structural arrangements depending upon the type of footwear that is contemplated for use.

Figure 9:
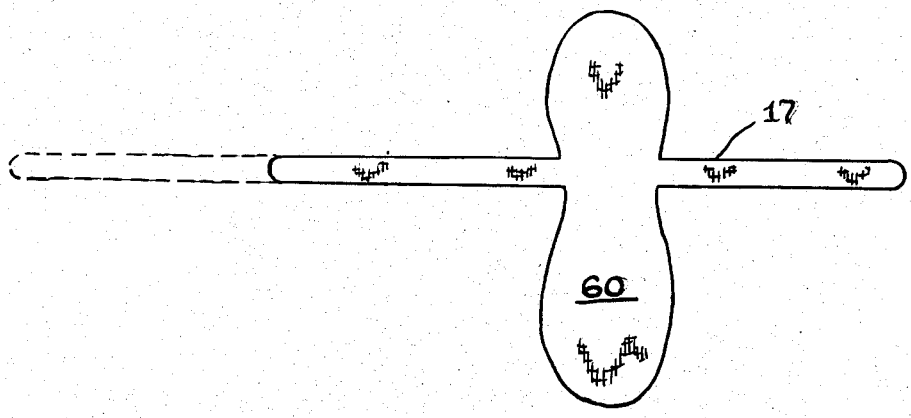
FIG. 9 is a detail view of one form of a shoe sole fabricated in accordance with this invention.

Examples of alternate means (15) contemplated for use in this invention would comprise, but not be limited to: slots (40) or recesses (50) on, or in, the soles (60) of the shoes; and, soles of shoes, wherein the strap element (12) is fabricated as an integral part of the sole (60) as shown in FIG. 9. The primary consideration for the means (15) being that the strap unit (12), or an extension thereof, encircle the arch (21) of the user's foot.

The elongated strap unit (12) comprises in general an elongated, relatively wide resilient strap element (17). The strap element (17) in the preferred embodiment has a sufficient length to encircle both the user's foot (20) in the vicinity of the arch (21) and the ankle (22). Once the user's arch and ankle have been enwrapped by the strap element (17), the free ends (18) of the strap element are secured to complete the tie system (10).

It should be obvious at this point that in order for the tie system to be effective, the free ends (18) of the strap element must be immobilized with respect to one another and/or the shoe (13). It should also be obvious that the immobility of the strap ends (18) can be accomplished in any number of ways.

Some of the ways contemplated to accomplish the immobilization are as follows: tying a knot with the ends (18) of the strap element; or, providing the strap ends (18) with fastening means that either cooperate with one another, or with complementary fastening means provided on the shoe (13). Some of the fastening means contemplated (but not shown) may comprise buckles, snaps, clasps or the like, whereas the preferred fastening means would comprise one portion of a VEL- CRO type fastener (19), and the complementary fastening means (19') would comprise the other portion of a VELCRO type fastener. Obviously, any suitable immobilizing method or means can be used in conjunction with the teachings of this invention.

The preferred method of employing the tie system is best shown in FIGS. 2 through 4 and 7. In the preferred embodiment, the mid-point of the elongated strap element (17) is disposed beneath the user's arch, and the free ends (18) of the strap element are pulled outwardly to place the straps under tension. The strap ends are then crossed over the top of the user's foot and then wrapped around the back of the user's ankle. The free ends of the strap are then brought forward on the shoe (13), recrossing the top of the user's foot and either connected together by the alternate fastening means mentioned, or attached to the shoe by engagement of the one portion (19) of the VELCRO type fastener with the complementary fastening means (19') disposed on the shoe (13).

Figure 8:
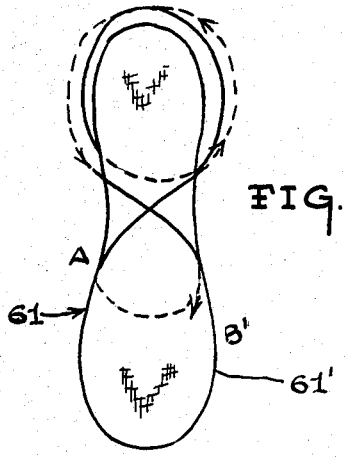
FIG. 8 illustrates the alternate mode of foot encirclement provided by the alternate embodiment.

In the alternate embodiment depicted in FIGS. 6 and 8, the elongated strap element (17) is fixedly secured on one side of the shoe (13) and adapted to be releasably secured to the other side of the shoe after encircling the user's ankle at least once.

In this embodiment, the elongated strap element (17) may be fabricated as a single integral extension of the sole (60) of the shoe (13) (shown in phantom in FIG. 9); or, the strap element (17) may be a distinct elongated member having one end permanently affixed to one side of the shoe upper (61).

In either of the aforementioned forms of this alternate embodiment, a releasable securing means (80) must be provided on the other side of the shoe upper (61) for immobilizing the single free end (18) of the strap element. As mentioned previously, a VELCRO type complementary fastening arrangement is preferred; however, the buckle (81) and apertured strap (82) arrangement depicted in FIG. 6 would be equally suitable for this version.

It should also be noted at this juncture that while the strap element (17) has heretofore been described as generally resilient, there may be some instances wherein generally flexible would be more accurate. In this latter instance, it is contemplated that the strap element (17) will be fashioned along the lines of a generally flat, wide leather belt, or the like.

The alternate method of employing the tie system is best depicted in FIG. 8, wherein the wrapping pattern of the strap element around the user's ankle (22) is depicted by both solid and broken lines. As can be seen by reference to FIG. 8, the elongated strap element (17), which is fixedly secured to one side of the shoe, has a sufficient length to encircle the user's ankle at least once (solid lines) and possibly twice (solid and broken lines) prior to being releasably secured to the other side of the shoe upper.

It should be appreciated by now that the shoe tie system heretofore described defines a major improvement over existing footwear securing methods, in that both arch support and lateral ankle stability are significantly enhanced by virtue of the provisions of this invention.

Having thereby described the subject matter of this invention it should be obvious that many substitutions, modifications and variations of the invention are possible in light of the teachings contained herein. It is therefore to be understood that the invention as taught and described is only to be limited to the extent of the breadth and scope of the appended claims.

I claim:

1. An improved tie system in combination with footwear such as shoes having a sole and an upper; wherein the tie system consists of:

fastening means affixed on opposite sides of the shoe upper adjacent the arch; and a pair of elongated wide resilient strap elements each having one end affixed on opposite sides of the shoe adjacent the arch and each having a free end provided with complementary fastening means; wherein the free ends of the strap elements extend across the top of the shoe upper, wrap around the back of the users ankle, and recross the tops of the shoe upper; whereby the complementary fastening means on the free ends of the strap element engage the fastening means on the opposite sides of the shoe upper adjacent the arch, thereby producing a double wrap tie system; whereby, each of said strap elements originates and terminates on opposite sides of the shoe proximate the sole of the shoe, to encircle the users foot in a substantially completed figure eight wrapping pattern.

* * * * *